United States Patent [19]

Stegmüller

[11] Patent Number: 4,962,289

[45] Date of Patent: Oct. 9, 1990

[54] SWITCH CHAMBER FOR A VACUUM SWITCH

[75] Inventor: Karl Stegmüller, Wiesent, Fed. Rep. of Germany

[73] Assignee: Sachsenwerk Aktiengesellschaft, Regensburg, Fed. Rep. of Germany

[21] Appl. No.: 385,427

[22] Filed: Jul. 27, 1989

[30] Foreign Application Priority Data

Jul. 27, 1988 [DE] Fed. Rep. of Germany ..... 3825407

[51] Int. Cl.[5] ..... H01H 33/66

[52] U.S. Cl. ..... 200/144 B

[58] Field of Search ..... 200/144 B

[56] References Cited

U.S. PATENT DOCUMENTS 3,082,307 3/1963 Greenwood et al. ..... 200/144 B

FOREIGN PATENT DOCUMENTS 3216251 11/1983 Fed. Rep. of Germany .
3501603 8/1985 Fed. Rep. of Germany .
3636966 5/1987 Fed. Rep. of Germany .
3544972 6/1987 Fed. Rep. of Germany .

OTHER PUBLICATIONS

"Hütte, " *Theoretische Grundlagen,* Verlag Von Wilhelm Ernst & Sohn, Berlin, 1955, pp. 1048–1049.

*Primary Examiner*—Robert S. Macon
*Attorney, Agent, or Firm*—Spencer & Frank

[57] ABSTRACT

A switch chamber for a vacuum switch including a housing composed of a ceramic insulating tube, a contact pin mounting a stationary contact within the housing and a terminating cover connecting the insulating tube with the contact pin in a vacuum-tight manner. Another contact is positioned adjacent the stationary contact and is movable in the axial direction of the insulating tube. A bellows forms a vacuum-tight connection between the movable contact and the housing. In the switched-on position the movable contact contacts the stationary contact under action of a contact spring force and shock stresses are transferred to the housing by the terminating cover which includes an elastically deformable section and a plastically deformable section. The elastically deformable section has an inner end connected with the contact pin and an outer end connected to the plastically deformable section which in turn is fastened to the ceramic tube thereby forming a vacuum-tight housing and minimizing stresses at the point of connection to the ceramic tube resulting from switching operations, short-circuits and shrinkage caused by manufacturing processes.

23 Claims, 5 Drawing Sheets

SWITCH CHAMBER FOR A VACUUM SWITCH

CROSS REFERENCE TO RELATED APPLICATION

This application claims the priority of application Ser. No. P 38 25 407.7 filed Jul. 27th, 1988, in the Federal Republic of Germany, the subject matter of which is incorporated herein by reference.

BACKGROUND OF THE INVENTION

The present invention relates to a switch chamber for a vacuum switch including a housing having at least one insulating tube, and in which a stationary contact pin supports the switch chamber and mounts a stationary contact, and a terminating cover connects the insulating tube with the contact pin in a vacuum-tight manner. In this type of switch chamber a movable contact has a frontal face positioned adjacent the stationary contact and is movable approximately in the axial direction of the insulating tube. A bellows forms a vacuum-tight connection between the movable contact and the housing. In the switched-on position of the vacuum switch the frontal face of the movable contact contacts the stationary contact under action of a contact spring force and the shock stresses generated when the vacuum switch is turned on are transferred to the housing by the terminating cover.

Such a switch chamber is disclosed in U.S. Pat. No. 3,082,307 which shows, with reference to FIG. 6 therein, a chamber having a stationary switch contact which is fastened to a tubular contact pin which, in turn, has a vacuum-tight connection with a tubular isolator by way of an intermediate member or terminating cover that is curved at its outer and inner ends. According to the drawing of the cited patent the isolator is made of glass into which the outer end of the intermediate member is melted while the inner end is connected with the exterior of the contact pin in the manner of a collar, presumably by soldering. The cited reference does not disclose anything about the mechanical characteristics of the intermediate member or about problems arising in connection with this component.

The above described prior art switch chamber is obviously intended for a relatively low operating and test voltage. The tubular isolator is actually two isolator parts having small dimensions with a metal housing disposed between them. The housing and intermediate members terminating the isolators have relatively large dimensions. There is a small annular gap between the contact pin and the isolator which results in the elastic intermediate member, in spite of its curvature, reacting to mechanical deformations with a high spring constant. The shocks transferred from the stationary contact to the housing during switching-on generate axially directed mechanical vibrations in the housing which may result in great stresses on the isolator, primarily in the melted connection zone of the intermediate member.

Due to advance ignition in thee-phase high voltage switching equipment, currents occur before there is any galvanic contact between the switch contacts. In the case of a short-circuit, these currents generate great, laterally acting forces. If the short-circuit currents are high, these forces may lead to lateral displacement of the contact pin and to eccentric connection between the contacts themselves, which may also result in twisting forces relative to the axial axis of the switch chamber.

The prior art switch chamber is not designed for such stresses since the curved intermediate member acts as a clamped-in carrier at both its inner and outer ends, i.e. transfers a clamping moment to the isolator. However, for the isolator, this type of stress constitutes a particular danger since dynamic operating stresses are added to the shrinkage stresses caused by manufacturing processes.

SUMMARY OF THE INVENTION

It is an object of the present invention to increase the fatigue limit of the housing for switch chambers of vacuum switches relative to all stresses from switching processes that occur during operation and in the case of malfunctions.

The above and other objects are accomplished according to the invention wherein there is provided a switch chamber of the type first described above wherein the insulating tube comprises a ceramic tube and the terminating cover comprises an elastically deformable section and a plastically deformable section. The elastically deformable section has an inner end connected with the contact pin and an outer end connected to the plastically deformable section which in turn is fastened to the frontal face of the ceramic tube thereby forming a vacuum-tight housing and minimizing stresses between the terminating cover and the ceramic tube resulting from switching operations, short-circuits and shrinkage caused by manufacturing processes.

The invention intends primarily to improve modern switch chambers for rated voltages of 12 kV and more which are customarily equipped with ceramic isolators.

The aim of the invention is to contain the thermally caused shrinkage stresses occurring during the manufacturing process at the critical components of the housing of the switch chamber and the stresses caused by electric current forces during switching processes and in the case of a short-circuit so that such stresses remain clearly below the fatigue limit of these components, even if such stresses are frequently repeated.

The problems of the task at hand can be described with the aid of the following considerations:

According to the German standard for ceramic materials, DIN 40,685, the coefficient of linear expansion for porcelain is 4 to $$6 \cdot 10^{-6}\left[\frac{1}{k}\right],$$

where k is measured in degree Kelvin, or 4 to $6 \cdot 10^{-6}$ meter per meter and Kelvin.

Further, according to "Hütte", *Theoretische Gundlagen (Theoretical Basics),* published by Verlag Wilhelm Ernst & Sohn, Berlin, 1955, the linear expansion coefficients for iron, copper and chromium-nickel steel are:

$$\text{iron } 12.3 \cdot 10^{-6}\left[\frac{1}{k}\right]$$

$$\text{copper } 16.2 \cdot 10^{-6}\left[\frac{1}{k}\right]$$

-continued chromium-nickel steel $16.5 \cdot 10^{-6} \left[\frac{1}{k}\right]$

At a soldering temperature of about 800° C., the following paired materials present theoretical diameter differences ΔD after cooling, given a nominal diameter D=100 mm as follows:

paired materials:

$$\left.\begin{array}{c}\text{porcelain} - \text{copper} \\ \text{or} \\ \text{porcelain} - \text{chromium-nickel steel}\end{array}\right\} \Delta D = 0.8 - 0.96 \text{ mm}$$

If one further assumes that the soldered-together materials exhibit an elastic behavior over the entire temperature range, a shrinkage stress $\sigma_{sh}$ of about $$\sigma_{sh} = 300 \text{ to } 400 \text{ N/mm}^2$$

would result for the ceramic tube in the vicinity of the solder location for the customary solder connection. The actually occurring values, primarily for copper, are lower due to the plastic deformation of the metals at higher temperatures.

Due to significantly higher values of thermal expansion of the metals, the shrinkage process results in an inwardly directed pressure stress on the ceramic tube. The above-calculated values approach the compressibility of high performance porcelains listed as 450 and 550 N/mm$^2$.

This consideration reveals that the reduction of shrinkage stresses on the ceramic tube has great significance in the solution of the problem on which the present invention is based.

To reduce the vibration stresses created by the switching processes and the short-circuit current forces, the invention provides an almost complete "decoupling" of the housing mass from the contact pin of the stationary contact and its suspension in the switch by minimizing the spring constants of the terminating cover and simultaneously increasing the number of degrees of freedom of mobility for the contact pin within the housing.

Considerable forces act on the two contacts and their contact pins at the instant of contact when the switch is turned on in the case of a short-circuit. This may result in an eccentric first contact location over which the entire kinetic energy of the movable contact is transferred. This off-center stress on the stationary contact may result in additional laterally acting forces which must not be transferred, or only to a harmless degree, to the critical housing components. This also applies for accelerations occurring during turn-off. A small spring constant for the terminating cover can be realized by a curved or corrugated shape or by the use of a bellows-like component. With such a configuration, it is possible to realize not only a significant reduction in the forces tending to axially displace the housing, but also a certain mobility in the radial direction and in the direction of an inclination of the contact pin axis compared to prior art planar plates or frustoconical faces.

BRIEF DESCRIPTION OF THE DRAWINGS

For a better understanding of the invention, reference is made to the drawing figures wherein.

DETAILED DESCRIPTION OF THE PREFERRED EMBODIMENTS

Figure 1:
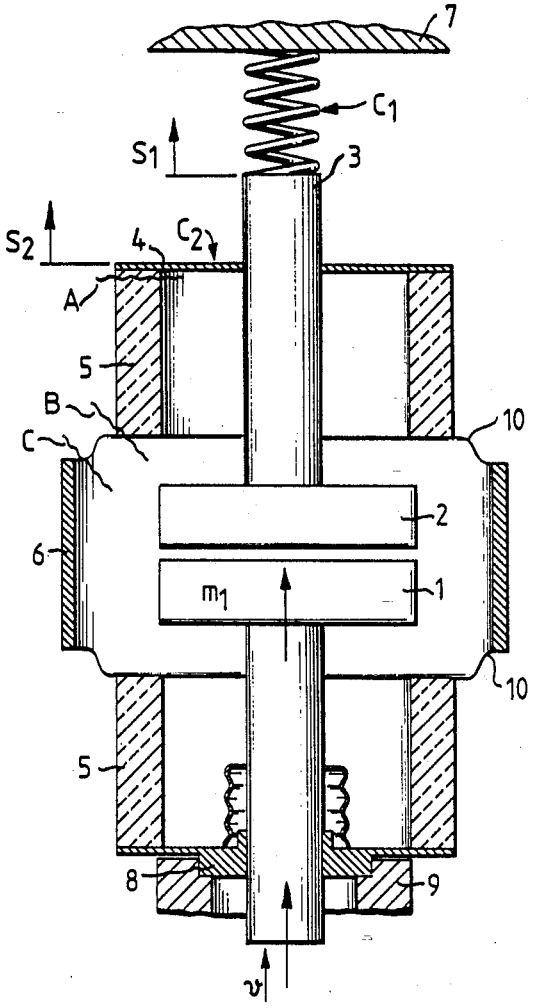
FIG. 1 is a schematic representation of a switch chamber of a prior art vacuum switch.

A description of the problems involved is first made with reference to FIG. 1. During a turn-on process, the mass $m_1$ of a movable contact 1 is brought into contact at a velocity $v$ with a stationary contact 2 which has approximately the same mass as contact 1. The switch chamber is fastened to a transverse member 7 by way of a stationary contact pin 3 and another part, for example a pin-type insulator (not shown). The elasticity of this latter part, together with the elasticity of contact pin 3, results in a spring constant $C_1$. Upon closing of the contacts, the kinetic energy of movable contact 1 produces an elastic deflection $S_l'$ of contact pin 3 according to the following equation:

$$\tfrac{1}{2} m_1 v^2 = \tfrac{1}{2} \cdot C_1 S_1'^2$$

Simultaneously with closing of the contacts, a contact force $F_k$ also comes to bear, and a static deflection $S_1$ of the magnitude $$S_1'' = \frac{F_k}{C_1}$$

is added to the elastic deflection $S_l'$. The total deflection $S_l = S_1 + S_1''$ now also excites the mass $m_G$ of the housing by way of a spring constant $C_2$ of cover 4 to go into elastic vibrations whose deflection $S_2$, at a high frequency, $$f_2 = \frac{1}{2\pi} \sqrt{\frac{C_2}{m_G}}$$

may lead to considerable stresses particularly at connection points A, B and C. Under a particularly unfavorable constellation, breaks or leaks may develop at these locations. With more critical scrutiny, the mass of the housing may also be subdivided into a separate mass for each ceramic tube part 5 and a mass for the metal jacket tube 6. Each one of these parts, together with the respectively associated connecting member, e.g. flange 10, again constitutes a vibratory structure having a larger natural frequency than $f_2$. In addition to suspending the vacuum switch chambers from a transverse member 7, axial guidance of movable contact 1 in a recess of a supporting member 9 is provided in the form of a sleeve 8.

Figure 2:
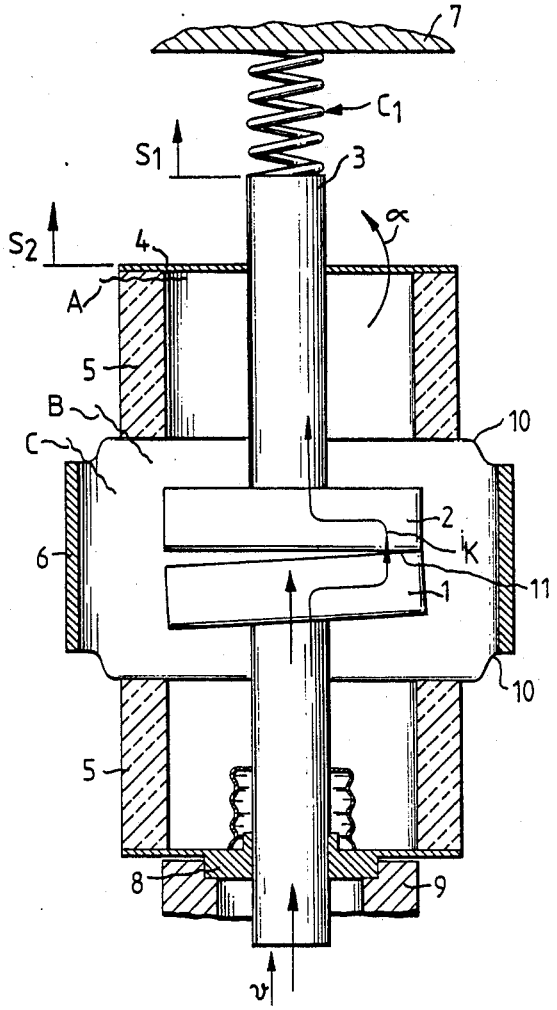
FIG. 2 is a schematic representation which shows the switch chamber of FIG. 1 during turn-on under short-circuit conditions.

FIG. 2 shows a prior art switch chamber undergoing a turn-on process under short-circuit conditions. At the moment contacts 1 and 2 are closed, a considerable current $i_k$ already flows and, because of elastic deformability, movable contact 1 goes into a skewed position which, for the sake of clarity, is shown in FIG. 2 in an exaggerated manner. The eccentric point of contact 11 resulting therefrom produces not only a deflection $S_l$ of contact 2 when the contacts hit one another but also a twist $\alpha$ which produces an additional curvature in cover 4 and excess stresses on the critical points of the housing, particularly at A. With a relatively stiff cover 4, this results in high mechanical stress peaks at individual locations within ceramic tube 5 and at the solder connection between cover 4 and ceramic tube 5.

In accordance with the principles of the invention, instead of the plate-shaped stiff cover of FIG. 1, the switch chamber of the invention provides for a terminating cover having an elastic section with a very low spring constant in conjunction with a plastically deformable section to reduce shrinkage stresses caused by the manufacturing process. According to one embodiment of the invention the elastic section is configured in a corrugated form.

Figure 3:
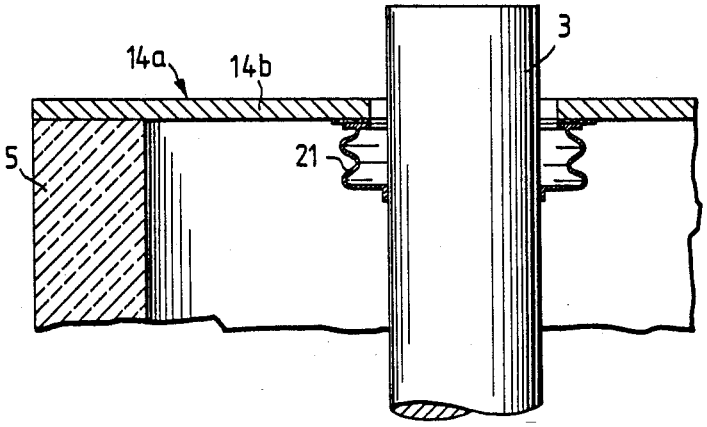
FIG. 3 is a partial schematic representation of an embodiment according to the invention which shows a terminating planar cover equipped with a bellows-like cylinder.

As shown in FIG. 3, a cover 14*a* forms the connection between ceramic tube 5 and contact pin 3 by way of an inner portion in the form of a bellows-type cylinder 21, i.e. a cylinder which is provided with a corrugated jacket. Cover 14*a* has an outer portion 14*b* made of a material having a low modulus of elasticity and a large plastic range, e.g. a copper free of gases. The bellows-type cylinder 21 is advantageously produced of a Cr-Ni steel having a low wall thickness of not greater than 1mm. Although cover 14*a* is connected with ceramic tube 5 in the conventional manner by means of a hard solder, the selection of materials for the terminating cover and the intermediary provision of bellows-type cylinder 21 serve to substantially avoid the generation of dangerous shrinkage stresses in the ceramic material as well as the transfer of axially and laterally directed forces to ceramic tube 5.

Figure 4:
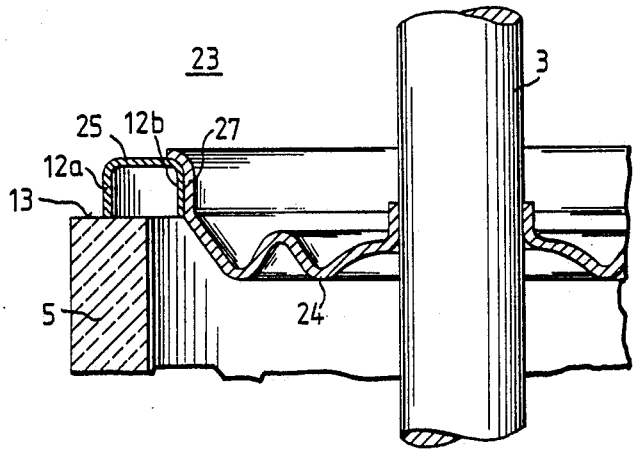
FIG. 4 is a partial schematic representation of a further embodiment according to the invention which shows a combined terminating cover.

Another embodiment of the terminating cover is shown in FIG. 4 in which a corrugated member 24 made of an elastic material, such as chromium-nickel steel having a wall thickness of at most 1 mm is connected with contact pin 3 while a thin walled ring 25 made of a plastic metal has its outer arm 12*a* soldered to the frontal face 13 of ceramic tube 5. Ring 25 may be designed, for example, to have a U or L-shaped cross section. Ring 25 is combined with corrugated member 24, likewise at a collar 27, by means of a vacuum-tight connection. As shown in FIG. 4, the locations at which corrugated member 24 are fastened to ring 25 and contact pin 3 are outside the evacuatable portion of the switch chamber. The embodiment shown in FIG. 4 permits shrinkage stresses to be reduced to a minimum in a particularly effective manner by the configuration of and selection of material for thin-walled walled ring 25. Preferably, thin-walled ring 25 is made of a gas-free copper.

Figure 5:
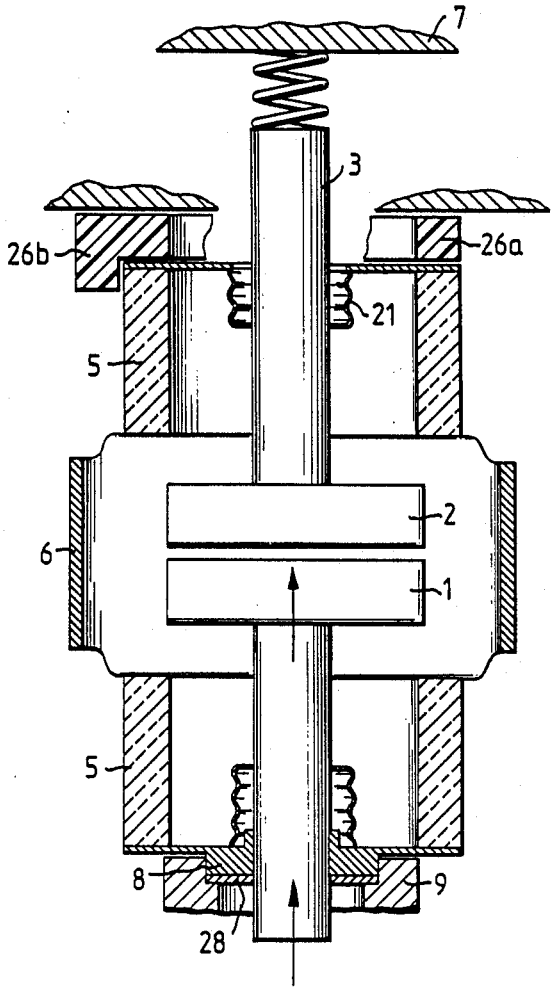
FIG. 5 is a schematic representation of an embodiment of the invention which shows a switch chamber with additional support.
Figure 6:
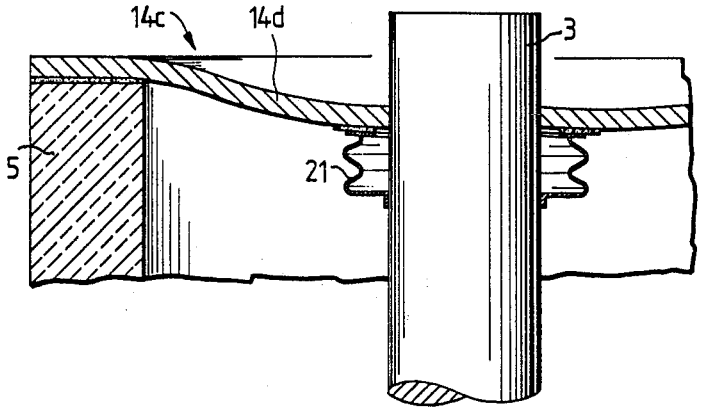
FIG. 6 is a partial schematic representation of an embodiment, where terminating cover is curved.

For switch chambers in which the configuration of the terminating cover permits a very great adjustability of the housing, for example if a bellows-type cylinder 21 is employed, a further feature of the invention shown in FIG. 5 provides for additional supports 26*a* and 26*b*, respectively, at the top to restrict mobility to predetermined values. Support 26*a* here acts exclusively as a limitation in the axial direction, and support 26*b* in the direction of all degrees of freedom permitted by the terminating cover according to the invention. The stated supports also prevent escape of the switch housing from supporting member 9, if there are externally caused vibrations which act on the switch. Supports 26*a* and 26*b* are composed, at least in part, of laminated steel sheets or of a plastic ring. Additionally, an elastic disc 28 may be provided in supporting member 9 to absorb mechanical shocks caused by the housing when it springs back. The elastic disc 28 consists i.e. of a suitable plastic material. Still another embodiment of the terminating cover is shown in FIG. 6. There instead of a planar cover as in FIG. 3 a curved cover 14*c* forms the connecting member between ceramic tube 5 and contact pin 3 by way of an inner portion in the form of an bellows-type cylinder 21, i.e. a cylinder which is provided with a corrugated jacket. Cover 14*c* has an outer portion 14*d* made of a material having a low modulus of elasticity and a large plastic range, e.g. a copper free of gases or soft-annealed. The bellow-type cylinder 21 is advantageously produced of a Cr-Ni steel having a low wall thickness of not greater than 1mm. Although curved cover 14*c* is connected with ceramic tube 5 in the conventional manner by means of a hard solder, the selection of materials for the terminating cover and the intermediary provision of bellows-type cylinder 21 serve to substantially avoid the generation of dangerous shrinkage stresses in the ceramic material as well as the transfer of axially an laterally directed forces to ceramic tube 5.

Figure 7:
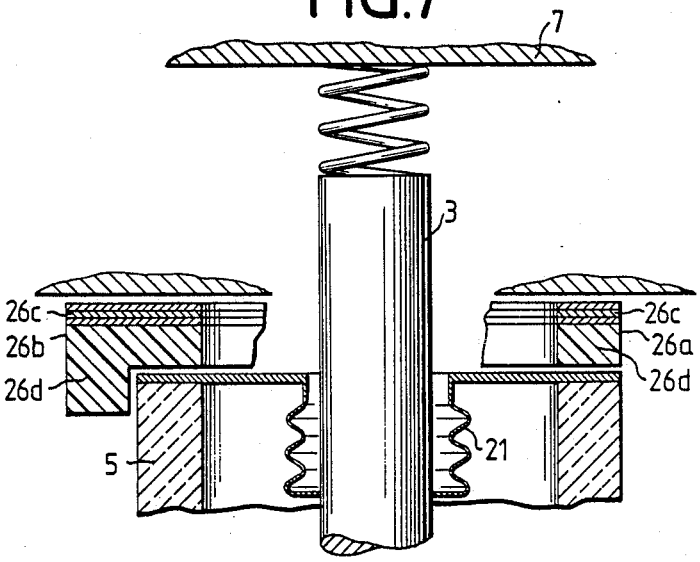
FIG. 7 shows a partial embodiment corresponding to FIG. 5 with a laminated support, which comprises a plastic ring too.

In FIG. 7 is shown the upper part of an embodiment corresponding to FIG. 5. Here the supports 26*a*, 26*b* are composed of laminated metal sheets 26*c* and a plastic ring 26*d* for damping movements of the switch chamber.

Elastic deformability means that a material is stressed lesser than to its elastic limit, while plastic deformability means that a material is stressed more than to its elastic limit. Plastically deformable materials are i.e. soft-annealed copper and other materials with a low modulus of elasticity, which are easy to deform.

The bellows-type cylinder 21 and corrugated member are made of a chromium-nickel alloy, i.e. a stainless steel of 18 percent of chromium end 9 percent of nickel.

Gas-free cooper is copper with a low content of oxygen.

Obviously, numerous and additional modifications and variations of the present invention are possible in light of the above teachings. It is therefore to be understood that within the scope of the appended claims, the invention may be practiced otherwise than as specifically described herein.

What is claimed is:

1. In a switch chamber for a vacuum switch comprising: a housing including at least one insulating tube having a frontal face; a contact pin for supporting the switch chamber relative to an external member; a terminating cover connecting the insulating tube with the contact pin in a vacuum-tight manner; a stationary contact held by the contact pin inside the housing; a movable contact having a frontal face adjacent the stationary contact and being movable approximately in the axial direction of the insulating tube; and a bellows forming a vacuum-tight connection between the movable contact and the housing; wherein in the switched-on position of the vacuum switch the frontal face of the movable contact contacts the stationary contact under action of a contact spring force and shock stresses generated when the vacuum switch is turned on are transferred to the housing by the terminating cover, the improvement wherein:

said insulating tube comprises a ceramic tube; and said terminating cover comprises an elastically deformable section and a plastically deformable section, said elastically deformable section having an inner end connected with said contact pin and an outer end connected to said plastically deformable section which in turn is fastened to the frontal face of said ceramic tube thereby forming a vacuum-tight housing and minimizing stresses between said terminating cover and said ceramic tube resulting from switching operations, short-circuits and shrinkage caused by manufacturing processes.

2. A switch chamber for a vacuum switch as defined in claim 1, wherein said elastically deformable section comprises a corrugated cover extending approximately perpendicularly to the axial axis of said ceramic tube.

3. A switch chamber for a vacuum switch as defined in claim 2, wherein said plastically deformable section comprises a thin-walled ring made of a plastically deformable material and said corrugated cover is connected with said thin-walled ring.

4. A switch chamber for a vacuum switch as defined in claim 3, wherein said thin-walled ring comprises a gas-free copper.

5. A switch chamber for a vacuum switch as defined in claim 3, wherein said corrugated cover has a cylindrical collar and said thin-walled ring has a U-shaped configuration including one arm connected with the frontal face of said ceramic tube and a second arm fastened to the cylindrical collar of said corrugated cover.

6. A switch chamber for a vacuum switch as defined in claim 5, wherein said switch chamber has an evacuatable portion and said corrugated cover is fastened to said contact pin and to the second arm of said thin-walled ring at locations disposed outside of said evacuatable portion.

7. A switch chamber for a vacuum switch as defined in claim 2, wherein said corrugated cover comprises a chromium-nickel steel having a wall thickness of at most 1 mm.

8. A switch chamber for a vacuum switch as defined in claim 1, wherein said elastically deformable section comprises a cylinder having walls in the form of a bellows.

9. A switch chamber for a vacuum switch as defined in claim 8, wherein said plastically deformable section comprises a planar shaped member connected at one end to said ceramic tube and at the other end to said cylinder, and the walls of said cylinder extend into the interior of said switch chamber.

10. A switch chamber for a vacuum switch as defined in claim 9, wherein said member comprises a gas-free copper.

11. A switch chamber for a vacuum switch as defined in claim 8, wherein said plastically deformable section comprises a curved member connected at one end to said ceramic tube and at the other end to said cylinder, and the walls of said cylinder extend into the interior of said switch chamber.

12. A switch chamber for a vacuum switch as defined in claim 11, wherein said curved member comprises a gas-free copper.

13. A switch chamber for a vacuum switch as defined in claim 8, wherein said cylinder comprises a chromium-nickel steel having a wall thickness of at most 1 mm.

14. A switch chamber for a vacuum switch as defined in claim 1, wherein said elastically deformable section includes means for giving mobility to said contact pin in a plurality of degrees of freedom within said ceramic tube.

15. A switch chamber for a vacuum switch as defined in claim 1, wherein said elastically deformable section of said terminating cover includes means for permitting transversal mobility of said contact pin in the axial and radial directions as well as rotational mobility of said contact pin relative to the axial axis of said ceramic tube.

16. A switch chamber for a vacuum switch as defined in claim 1, and further comprising a guide sleeve disposed for axially guiding said movable contact; and a support member for supporting said switch chamber on the side of said movable contact.

17. A switch chamber for a vacuum switch as defined in claim 16, and further comprising an elastic disc positioned between said guide sleeve and said support member.

18. A switch chamber for a vacuum switch as defined in claim 16, and further comprising a support disposed in the region of the frontal face of said ceramic tube, said housing lying against said support when said contacts are closed.

19. A switch chamber for a vacuum switch as defined in claim 18, wherein said support prevents said housing from sliding out of said supporting member.

20. A switch chamber for a vacuum switch as defined in claim 18, wherein said support includes a portion which damps movement of said switch chamber and comprises one of laminated metal sheets and a plastic ring.

21. A switch chamber for a vacuum switch as defined in claim 1, wherein connections between components of said terminating cover and components fastened thereto are solder connections.

22. A switch chamber for a vacuum switch as defined in claim 1, wherein connections between components of said terminating cover and components fastened thereto are welded connections.

23. A switch chamber for a vacuum switch as defined in claim 1, and further comprising a support disposed in the region of the frontal face of said ceramic tube so that when said contacts are closed said housing lies against said support and is guided on all sides by said support.

* * * * *